US008847565B2

(12) United States Patent
Vemula

(10) Patent No.: US 8,847,565 B2
(45) Date of Patent: Sep. 30, 2014

(54) SHUNT REGULATOR FOR ADVERSE VOLTAGE/CIRCUIT CONDITIONS

(75) Inventor: Madan Mohan Reddy Vemula, Tempe, AZ (US)

(73) Assignee: NXP B.V., Eindhoven (NL)

( * ) Notice: Subject to any disclaimer, the term of this patent is extended or adjusted under 35 U.S.C. 154(b) by 64 days.

(21) Appl. No.: 13/618,444

(22) Filed: Sep. 14, 2012

(65) Prior Publication Data

US 2014/0077788 A1 Mar. 20, 2014

(51) Int. Cl.
*G05F 1/00* (2006.01)

(52) U.S. Cl.
USPC ..... 323/271

(58) Field of Classification Search
USPC ..... 323/313–316, 901, 268–275; 327/538–546; 307/108; 361/108
See application file for complete search history.

(56) References Cited

U.S. PATENT DOCUMENTS

| | | | | |
|---|---|---|---|---|
| 5,148,099 | A | 9/1992 | Ong | |
| 5,666,044 | A * | 9/1997 | Tuozzolo | 323/277 |
| 6,141,193 | A * | 10/2000 | Mercer | 361/18 |
| 6,737,908 | B2 * | 5/2004 | Mottola et al. | 327/539 |
| 6,756,838 | B1 * | 6/2004 | Wu et al. | 327/536 |
| 6,933,770 | B1 * | 8/2005 | Ranucci | 327/539 |
| 6,998,830 | B1 | 2/2006 | Henry et al. | |
| 8,313,034 | B2 * | 11/2012 | Okuda | 235/492 |
| 2005/0046405 | A1 * | 3/2005 | Trafton et al. | 323/308 |
| 2006/0104001 | A1 * | 5/2006 | Yoshio | 361/103 |
| 2007/0205824 | A1 * | 9/2007 | Perisetty | 327/536 |
| 2007/0290660 | A1 * | 12/2007 | Yamazaki | 323/222 |
| 2008/0136384 | A1 | 6/2008 | Al-Shyoukh et al. | |
| 2009/0108917 | A1 * | 4/2009 | Chellappa | 327/539 |
| 2010/0090014 | A1 * | 4/2010 | Okuda | 235/492 |
| 2011/0089916 | A1 | 4/2011 | Soenen et al. | |
| 2013/0141059 | A1 * | 6/2013 | Parkhurst et al. | 323/271 |

OTHER PUBLICATIONS

Hilbiber, D.F., "A new semiconductor voltage standard," 1964 International Solid-State Circuits Conference: Digest of Technical Papers 2: 32-33 (1964).

* cited by examiner

*Primary Examiner* — Timothy J Dole
*Assistant Examiner* — Yusef Ahmed

(57) ABSTRACT

Low voltage circuits are protected from high voltage/current conditions, as may be implemented in accordance with one or more example embodiments. An additional/secondary shunt circuit/switch is implemented to shunt additional current as supply voltage steps or otherwise increases. In some implementations, the secondary shunt circuit includes a transistor having its drain coupled to its gate via a large capacitance that operates to maintain the gate voltage at about a constant level. This operates to facilitate the draining of additional current, and maintaining a low bandgap voltage supply level.

19 Claims, 4 Drawing Sheets

SHUNT REGULATOR FOR ADVERSE VOLTAGE/CIRCUIT CONDITIONS

Many circuits are susceptible to electrical overstress as may relate to overvoltage or overcurrent conditions that can be damaging, such as electrostatic discharge (ESD), fault conditions, battery voltage shorting (e.g., to USB supply for an automobile adapter), hot plug events, overshoot conditions (e.g., during power up events or due to a change in load conditions/other events). To address such overstress, protection circuits that generally operate like a switch are used to bypass/shunt current during an electrical overstress condition. In the case of an electrical overstress, such protection circuits switch to a low ohmic state, to connect an input (or other circuit) to a reference terminal such as a ground, common or lower-level power-rail terminal, thus shunting excessive charge to ground or common terminal where it does not harm the circuit.

An example application in which protection circuits are desirably used relates to the connectivity of devices, such as hand-held and other portable devices, for communication and/or power supply. For instance, universal serial bus (USB) connectors are used for devices such as telephones and tablets, and can be used for both the communication of data and the transmission of power, for active use and/or battery charging. However, such connections can be susceptible to undesirable spikes in voltage. These voltage spikes can harm the circuits to which the connectors are coupled (e.g., a USB car battery charger can reach 20V during a faulty condition, which could stress low voltage devices). For example, reliability issues such as oxide breakdown, source-substrate breakdown and drain-source breakdown can occur during overvoltage conditions.

These and other matters have presented challenges to the implementation of protection circuits, for a variety of applications.

Various example embodiments are directed to current shunting circuits and their implementation.

According to an example embodiment, an apparatus includes a low voltage supply circuit, a current limit circuit, a startup circuit and a shunt circuit. The low voltage supply circuit provides a low voltage output using an internal voltage line subject to voltage fluctuations, and the current limit circuit couples the internal voltage line to a external voltage line and limits current passed there between. The startup circuit is connected between the internal voltage line and a reference circuit and provides a startup voltage for the low voltage supply circuit, which is (at least) a minimum voltage required for the low voltage supply circuit to operate. The shunt circuit is coupled between the internal voltage line and the reference circuit, and includes a switch and a control circuit that controls the switch to shunt current between the internal voltage line and the reference circuit to regulate voltage on the internal voltage line at an about constant level.

Another example embodiment is directed to a current-shunting apparatus. A bandgap reference voltage circuit is coupled to a bandgap voltage supply line and configured and arranged to provide a bandgap reference voltage output (e.g., to provide a low reference voltage to internal circuits using power sourced from a higher supply line). A first resistor is coupled between an external voltage supply line (subject to voltage fluctuations) and a bandgap voltage supply line, and another (second) resistor is coupled, via the bandgap voltage supply line, to the first resistor and the bandgap reference voltage circuit. A shunting circuit shunts current between the bandgap voltage supply line and the ground circuit, and includes a transistor having its drain/source connected between the bandgap voltage supply line and the ground circuit respectively and its gate connected to the bandgap voltage supply line via the second resistor. A capacitor is connected across the gate of the shunting circuit and ground/common terminal. The capacitor operates to maintain the voltage at the gate at an about steady value in response to voltage fluctuations on the bandgap voltage supply line (e.g., as following the external off chip line voltage fluctuations). The shunting circuit is responsive to the voltage at the gate and an increase in voltage on the bandgap voltage supply line by passing increased current between the bandgap voltage supply and the ground circuit and regulating the bandgap voltage supply to the bandgap reference voltage circuit at an about constant level. A startup circuit is coupled between the second resistor and ground to provide a startup voltage for the bandgap reference voltage circuit via mitigation of current flow through the shunting circuit when the voltage level on the bandgap voltage supply line is less than the a minimum voltage at which the bandgap reference circuit can operate.

Another apparatus is directed to a circuit including a first transistor having a source, drain, bulk/nwell and gate; a ground circuit connected to the drain of the first transistor; and a first resistor connected between an external line voltage and both an internal voltage rail and the source of the first transistor. A capacitor is connected between the drain and gate of the first transistor and maintains a voltage level at the gate of the first transistor at an about constant value in response to a voltage on the internal voltage rail of at least the constant value, and the first transistor drains current between the voltage line and the ground circuit in response to an increase in voltage of the internal voltage rail above the constant value. The circuit also includes a second resistor connected between the first resistor and the gate of the first transistor, a second transistor connected between the gate of the first transistor and the ground circuit, a third resistor between the second transistor and the gate, and a diode connected to the ground circuit and a third transistor connected to the second transistor. The diode operates with the second and third transistors to mitigate current flow via the first transistor in response to a voltage level on the internal voltage rail being below the level of the constant value. A bandgap reference voltage circuit is connected to the internal voltage rail via the first resistor, and operates using the constant (e.g., bandgap supply) voltage.

The above discussion/summary is not intended to describe each embodiment or every implementation of the present disclosure. The figures and detailed description that follow also exemplify various embodiments.

Various example embodiments may be more completely understood in consideration of the following detailed description in connection with the accompanying drawings, in which.

Figure 1:
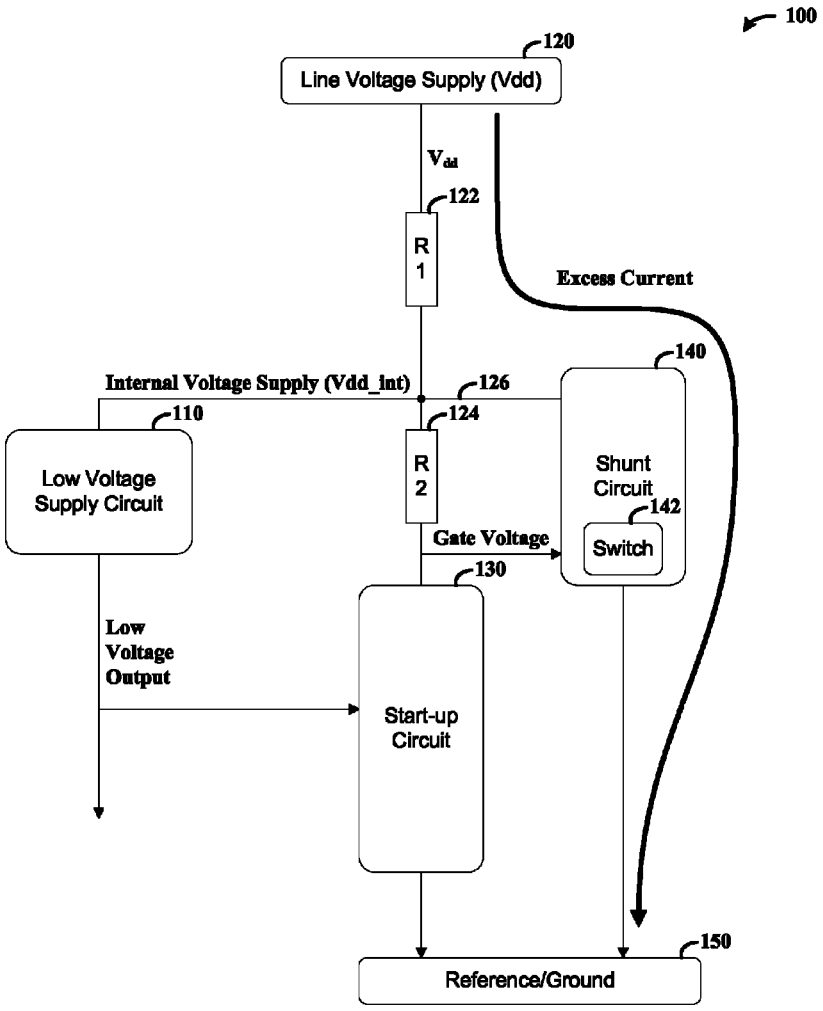
FIG. 1 shows a current-shunting circuit, in accordance with an example embodiment of the present invention.

While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims. In addition, the term "example" as used throughout this application is only by way of illustration, and not limitation.

Aspects of the present disclosure are believed to be applicable to a variety of different types of apparatuses, systems and methods involving protection circuits. While not necessarily so limited, various aspects may be appreciated through a discussion of examples using this context.

Various example embodiments are directed to a current shunting circuit that employs a startup circuit and a shunting circuit operated to provide a low voltage supply, such as for analog circuits involving a bandgap voltage. This shunting circuit shunts excess current through a resistor and limits the internal power supply to a value at which low voltage devices can operate (e.g., without causing reliability and/or stress issues). This approach facilitates the use of high supply voltages (e.g., 5-25V) to power low voltage (e.g., 5V) devices for a variety of applications susceptible to higher voltage conditions, such as those discussed in the background above. For instance, voltage spikes on an interface voltage supply such as that provided via USB, display port, HDMI, digital photography, car charger, or wall plug charger applications in which the voltage supply line can vary, are addressed while providing reference voltage.

In a more particular embodiment, a regulator includes a PMOS pass transistor and shunt regulator architecture with a resistive pull up circuit at the power supply voltage. As the power supply voltage increases, the shunt regulator drains more current through the resistive pull up circuit, and keeps the voltages inside the regulator at a value of less than about 5V. A secondary PMOS shunt switch drains current at a higher rate (e.g., in parallel with the regulator, while the regulator takes time to respond to the change in the supply voltage). In other embodiments, an NMOS regulator switch is used instead of a PMOS shunt switch, with an operational transconductance amplifier (OTA) supplying a gating voltage to the NMOS.

In accordance with a variety of embodiments, an apparatus employing a current shunt includes a current limiting circuit that couples an internal voltage line to a line voltage, and limits current passed therebetween. This current limiting circuit may, for example, be implemented using one or more resistors. A shunt circuit is coupled between the internal voltage line and a reference circuit (e.g., ground or other circuit held at a reference level). The shunt circuit includes a switch that shunts current between the internal voltage line and the reference circuit in a manner that regulates voltage on the internal voltage line at an about constant level. A control circuit operates to control the switch, such as by maintaining a consistent voltage in an on condition (e.g., above a threshold) such that the switch shunts excess current in such a condition. A low voltage supply circuit is coupled to the internal voltage line and uses the (regulated) voltage thereupon to provide a low voltage output. The apparatus further includes a startup circuit connected between the internal voltage line and ground, and operates to provide a startup voltage for the low voltage supply circuit under conditions in which the line voltage is low or ramping up (e.g., to flow current and/or mitigate current flow via the shunt circuit to raise the internal voltage line level to a level sufficient for the low voltage supply circuit to operate).

The control circuit is implemented using one or more of a variety of approaches, depending upon the implementation. In some embodiments, the control circuit includes or is otherwise coupled to a resistor coupled between the internal voltage line and the switch, to limit current provided at the switch, and to a capacitor coupled between the switch and the reference or ground terminal to maintain voltage on the switch. The capacitor may, for example, be implemented to mitigate coupling of transient voltages between the internal voltage line and the switch. In certain implementations, an OTA is further coupled between the capacitor and the switch.

The startup circuit may be implemented in a variety of manners, using a variety of circuits. In some embodiments, the startup circuit exhibits a voltage drop that is about equal to a saturation voltage for saturating (operating in an ON state) one or more transistors in a current path within the low voltage supply circuit, the path being between the internal voltage line and ground of the low voltage supply circuit. In this context, the startup circuit matches, or copies, the low voltage supply circuit and exhibits an appropriate voltage drop to ensure buildup of that minimum voltage for low voltage supply circuit before any (or much) current is shunted.

Turning now to the Figures, FIG. 1 shows a shunt regulator apparatus 100, in accordance with another example embodiment. The regulator apparatus 100 includes a low voltage supply circuit 110, current limit resistors 122 and 124 that limit current provided by a line voltage supply 120 (e.g., a high-voltage external supply line), a start up circuit 130, and a shunt circuit 140, with both the start up circuit and shunt circuit coupled to a ground/reference voltage level circuit 150. The current limit resistors 122 and 124 are configured and arranged to limit the current flow into the start up circuit 130, and to provide a minimum current flow into the low voltage supply circuit 110 based on requirements for circuits served by the low voltage supply circuit 110. Resistor 122 is connected between the external supply line (vdd) 120, which is subject to voltage fluctuations (e.g., ESD conditions or voltage overshoot during hot plug events for various connectors such as USB/battery charger/DP/HDMI cable connectors), and an internal voltage line (vdd_int) 126, which is held within a certain range to prevent damage to circuitry operating on vdd_int.

Excess current flows into the shunt circuit 140, via a shunt switch 142, operated by a gate voltage supplied via vdd_int through resistor 124. The switch 142 is set such that sufficient current flows into the low voltage supply circuit until voltage is built up via the start up circuit 130 at lower voltage levels (sub vdd_int) of the internal voltage line 126, and with the gate voltage being held to ensure operation of the switch for shunting current in excess of vdd_int.

In some implementations, the switch 142 is implemented with a transistor having its source coupled to the internal voltage line, its drain connected to the ground circuit and its gate connected to the internal voltage line 126 via the resistor 124. The switch 142 also includes a capacitor connected between the gate and drain, and operates with the resistor to maintain an about constant voltage level at the gate, irrespective of fluctuations in voltage on the internal voltage line 126. As voltage on the internal voltage line 126 rises above a vdd_int level used to operate the low voltage supply circuit 110 (plus any other voltage needed for operating the apparatus 100), the switch 142 operates in a closed position and the shunt circuit 140 shunts excess current (i.e., beyond that needed to provide the vdd_int level) to the ground/reference circuit 150. With this approach, the voltage supply to the low voltage supply circuit is regulated at an about constant level.

The startup circuit 130 operates to ensure that the shunt circuit 140 does not drain current until the internal voltage line at 126 is at minimum voltage required by the low voltage supply circuit 110 to operate. The startup circuit 130 can be implemented with one or more of a variety of circuits to achieve this functionality, and in some implementations in which the low voltage supply circuit is a bandgap reference circuit, the startup circuit includes a stack of two p-channel transistors and a parasitic vertical PNP device connected from vgate to the ground/reference circuit 150, operable with feedback from low voltage output provided by the low voltage supply circuit 110.

Figure 2:
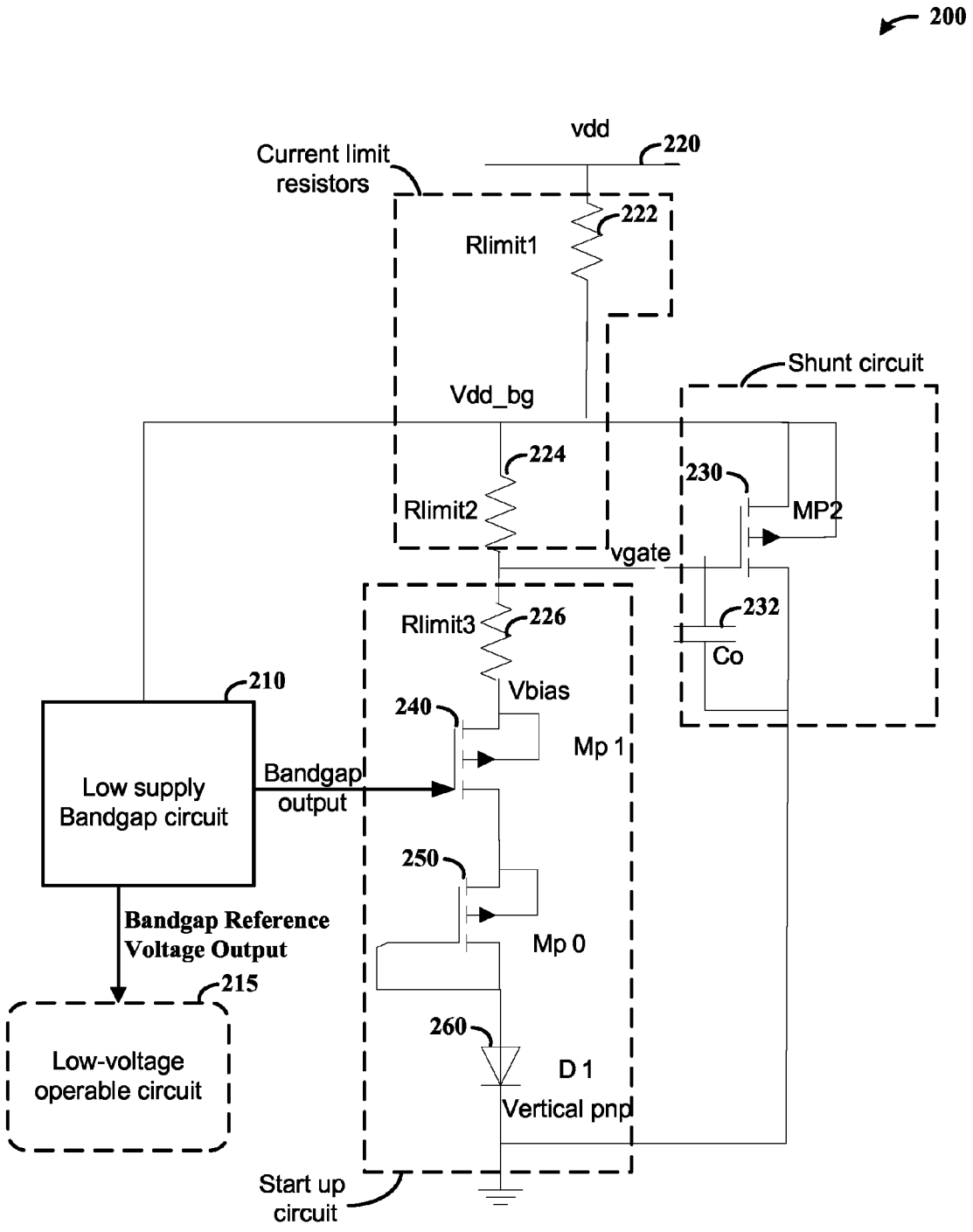
FIG. 2 shows another current-shunting circuit, in accordance with another example embodiment of the present invention.

FIG. 2 shows a shunt regulator circuit 200 that supplies a (low voltage/supply) bandgap reference voltage circuit 210 using a high voltage (e.g., external) supply line 220, in accordance with another example embodiment of the present invention. The high voltage supply 220 is susceptible to increases in voltage (e.g., Vdd up to 25V), which a regulating mechanism addresses. Specifically, the regulator circuit 200 includes a startup circuit including p-type transistor 240 having its gate coupled to the bandgap reference voltage circuit 210, and its source coupled to the high voltage supply 220 via resistors 222, 224 and 226. Transistor 250 (also p-type) and pnp diode 260 operate to build a voltage to facilitate startup of the bandgap supply. A shunt regulator circuit includes p-type transistor 230 having its gate coupled to its drain via capacitor 232. The transistor 230 also has its gate coupled to the bandgap reference circuit 210 via resistor 224, and its source coupled to the high voltage supply 220 via resistor 222. In some implementations, the circuit 200 also includes a circuit 215 operable on a low voltage output of the bandgap reference voltage circuit 210.

The circuit 200 can be implemented to account for a variety of different voltage conditions and circuit implementations, and to supply a variety of different types of bandgap reference voltage circuits 210. In one embodiment in which the high voltage supply 220 is susceptible to high voltages (e.g., of about 24V), the transistor 230 drains additional current to ground when there is a step in the input supply voltage, maintaining the bandgap supply (shown as vdd_bg) at a lower voltage. Specifically, the increase in Vdd results in an increase in vdd_bg, with transistor 230 being responsive by draining additional current. Under this operation, the capacitor 232 holds the gate of transistor 230 at (near) fixed voltage, which facilitates the current drain. The value of resistor 224 is large and therein limits current flow into MP1 and MP0, and also facilitates holding the voltage (vgate) at the gate of transistor 230 at about a constant voltage when Vdd is high. The value of resistor 222 is set to supply current for the bandgap reference circuit 210 at level sufficient to achieve the bandgap reference (e.g., minimum vdd voltage), with any additional current being drained via transistor 230, responsive to increased voltage at Vdd. In some implementations, the circuit 200 operates to switch the transistor 230 into an ON/current passing state at a threshold voltage corresponding to the sum of the bandgap reference voltage and respective threshold voltages of transistors 230 and 240.

In various contexts, the circuit 200 operates as follows. In response to a vdd_bg being not higher than a bandgap reference voltage output level of the bandgap reference voltage circuit 210, a first amount of current received via the voltage supply line is passed to the bandgap reference voltage circuit, a second amount of the current received is passed to ground via the transistors 240, 250 and diode 260, and a negligible amount of the current is passed to ground via the transistor 230, with the current passed via the bandgap reference voltage circuit 210 being a majority of the current. In response to vdd_bg being higher than the bandgap reference voltage, about the same amount of current is passed via the bandgap reference voltage circuit 210 and transistors 240, 250 and diode 260, and about all additional current is shunted to ground via the transistor 230 (e.g., at such a voltage level on vdd_bg, voltage at the gate of the transistor 230 switches the shunting on and continues to drain such excess current).

As consistent with one or more embodiments, the bandgap reference voltage is provided as a temperature independent voltage having a level that is about equal to the bandgap of silicon (e.g., about 1.22 V at a temperature of 0 K). For general information regarding reference voltage supply circuits, and for specific information regarding bandgap reference voltage circuits, reference may be made to Hilbiber, D. F., "A new semiconductor voltage standard," 1964 *International Solid-State Circuits Conference: Digest of Technical Papers* 2: 32-33 (1964), which is fully incorporated herein by reference.

Figure 3:
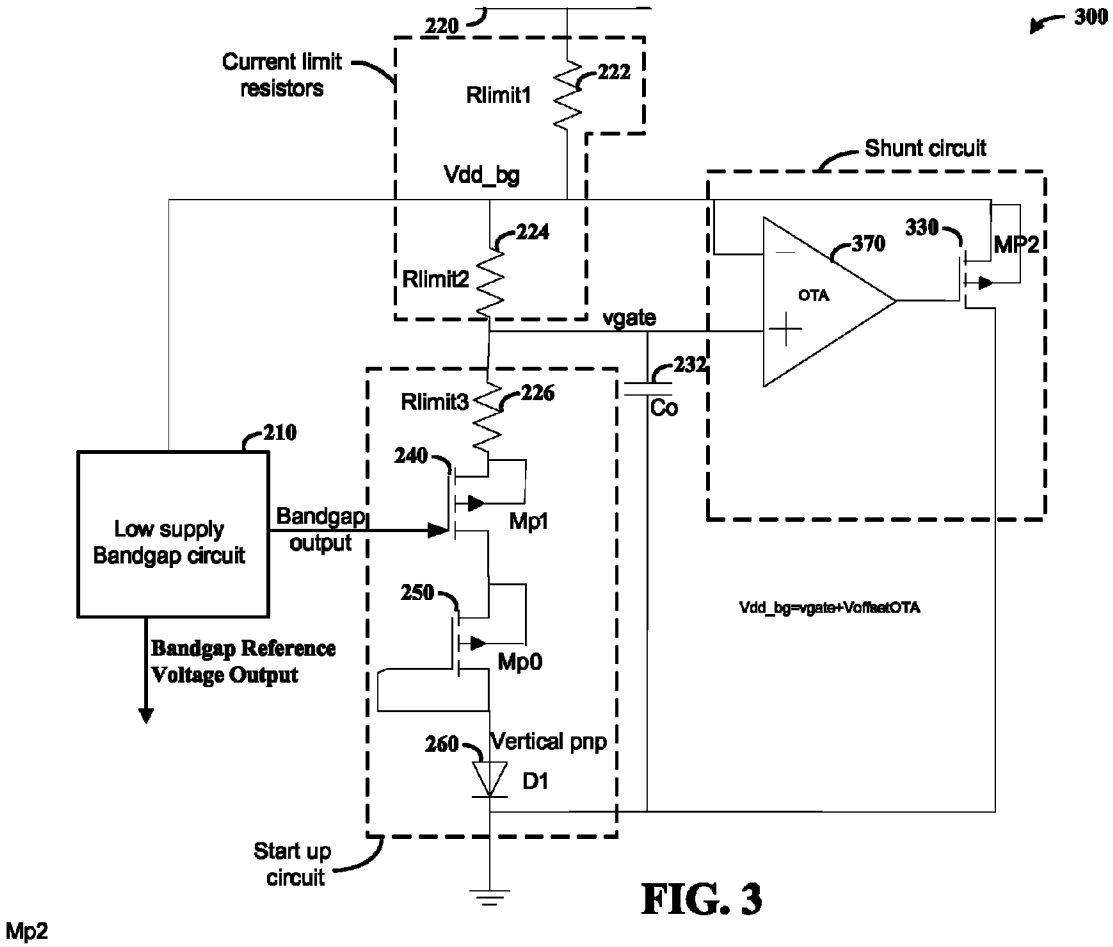
FIG. 3 shows a shunt regulator circuit, employing an operational transconductance amplifier (OTA), in accordance with another example embodiment of the present invention.

FIG. 3 shows another shunt regulator circuit 300, employing an operational transconductance amplifier OTA 370, in accordance with another example embodiment of the present invention. The circuit 300 is similar to the circuit 200 shown in and described in connection with FIG. 2, with similar components labeled consistently. Accordingly, the discussion of these similarly-labeled components above with FIG. 2 is applicable here to FIG. 3 as well.

The circuit 300 employs the OTA 370 as part of a shunting circuit, with its negative input coupled to vdd_bg, and its positive input coupled to the gating voltage coming off of resistor 224. Capacitor 232 is shown external to the dashed (example) line referring to a shunt circuit, but may be implemented as part thereof, and is coupled to the gate of transistor 330 via the output of OTA 370. The transistor 330 is a p-channel MOSFET, with its source coupled to vdd_bg and its drain coupled to ground. The OTA 370 operates with the transistor 330 and capacitor 232 to effect a shunting operation as shown in FIG. 2, such that current exceeding desired vdd_bg, plus an amount needed/used by the start-up and shunting circuits, is shunted to ground (and corresponding to vgate plus the offset voltage ($v_{offset}$) of the OTA). The p-channel MOSFET 330 responds to the transients, and the OTA 370 responds slowly and provides accurate regulating voltage on vdd_bg.

Figure 4:
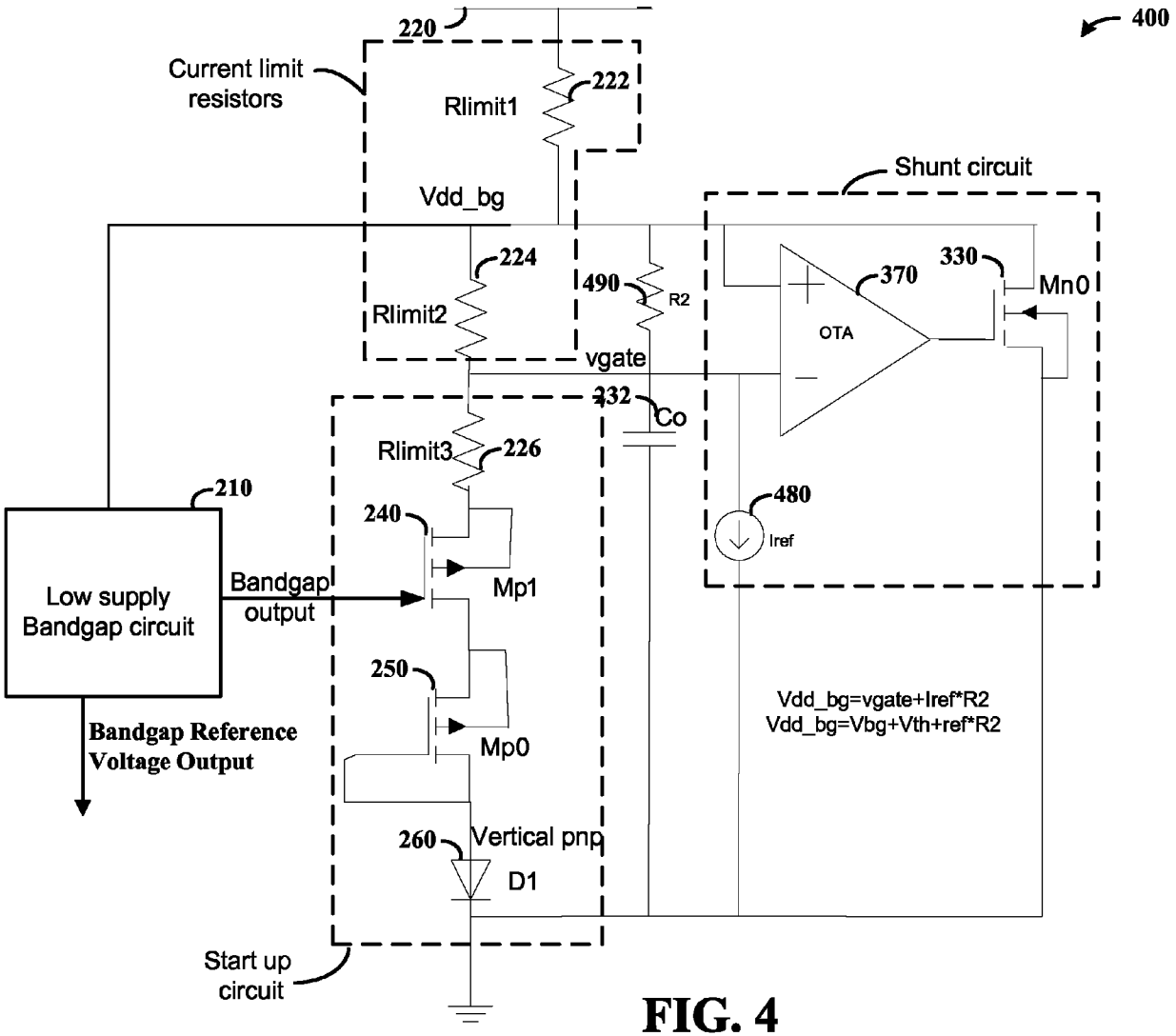
FIG. 4 shows another shunt regulator circuit employing an OTA and a reference current source, in accordance with another example embodiment of the present invention.

FIG. 4 shows another shunt regulator circuit 400, employing an operational transconductance amplifier (OTA) 370 with a reference current source 480, in accordance with another example embodiment of the present invention. The circuit 400 is similar to the circuit 300 shown in and described in connection with FIG. 3 (and accordingly with FIG. 2), with similar components labeled consistently. The discussion of these similarly-labeled components above with FIGS. 2 and 3 is thus applicable to FIG. 4, with its positive input coming from vdd_bg and its negative input coming form the gating voltage vgate.

The reference current source 480 operates with the capacitor 232, current source 480 (providing $I_{ref}$), OTA 370 and transistor 330, as well as an additional resistor 490 having a value R2, to effect a shunting operation as shown in FIGS. 2 and 3, such that current exceeding desired vdd_bg, plus an amount needed/used by the start-up and shunting circuits, is shunted to ground. The value of vdd_bg may thus corresponds to vgate+$I_{ref}$*R2, or in other words vdd_bg is voltage provided by the bandgap circuit 210 output plus a threshold voltage ($V_{th}$) for transistor 240 plus $I_{ref}$*R2.

Based upon the above discussion and illustrations, those skilled in the art will readily recognize that various modifications and changes may be made to the various embodiments without strictly following the exemplary embodiments and applications illustrated and described herein. For example, different circuits may be used to implement common functionality, such as to hold a constant gate voltage, or to provide a current limit function. Such modifications do not depart from the true spirit and scope of various aspects of the invention, including aspects set forth in the claims.

What is claimed is:

1. An apparatus comprising:

a first resistor coupled between a voltage supply line subject to voltage fluctuations and a bandgap voltage supply line;

a bandgap reference voltage circuit coupled to the bandgap voltage supply line and configured and arranged to provide a bandgap reference voltage output;

a second resistor coupled, via the bandgap voltage supply line, to the first resistor and the bandgap reference voltage circuit;

a first circuit configured and arranged to shunt current between the bandgap voltage supply line and a ground circuit, the first circuit including a first transistor having a source and drain coupled between the bandgap voltage supply line and the ground circuit, and a gate connected to the bandgap voltage supply line via the second resistor, and a capacitor coupled between the gate and the ground circuit and configured and arranged with the second resistor to maintain the voltage at the gate at an about steady value in response to voltage fluctuations on the bandgap voltage supply line, the first circuit being responsive to the voltage at the gate and an increase in voltage on the bandgap voltage supply line by passing increased current between the voltage supply line and the ground circuit and regulating the voltage supply to the bandgap reference voltage circuit at an about constant level; and a second circuit coupled between the second resistor and the ground circuit, the second circuit being configured and arranged to provide a startup voltage for the bandgap reference voltage circuit by mitigating current flow via the first circuit in response to a voltage level on the bandgap voltage supply line that is less than a minimum voltage at which the bandgap reference circuit can operate.

2. The apparatus of claim 1, wherein the second circuit includes a second transistor having a source coupled to the bandgap voltage supply line via the second resistor and a gate coupled to the output of the bandgap reference circuit, a third resistor connected between the second transistor and the second resistor, the gate of the first transistor being connected to a node between the second and third resistors, a third transistor having a source, drain and gate, the source being coupled to a drain of the second transistor and the drain being coupled to the gate of the third transistor, and a p-n-p diode connected between the drain of the third transistor and the ground circuit.

3. The apparatus of claim 1, wherein the capacitor is connected between the gate and the drain of the first transistor, and the second resistor is configured and arranged to maintain current flowing into the start up circuit to prevent a voltage presented to the gate of the first transistor from rising during transient events on the voltage supply line, the second resistor having a resistance value greater than a resistance value of the first resistor and configured and arranged to limit current through the second circuit to a value about sufficient to provide the startup voltage.

4. The apparatus of claim 1, wherein the second circuit is configured and arranged with a voltage drop corresponding to a voltage drop across a current path including at least one transistor in the bandgap reference voltage circuit, that is sufficient to operate the at least one transistor in a saturation region.

5. The apparatus of claim 1, wherein the second resistor and the first transistor are configured and arranged respectively with a resistive value and gate threshold voltage that operate the first transistor in a high conductance state to shunt current from the bandgap voltage supply line to the ground circuit in response to voltage on the bandgap voltage supply line exceeding a threshold voltage above a bandgap reference voltage provided by the bandgap reference voltage circuit, and to operate the first transistor in a low conductance state to block current from passing through the first circuit when the voltage on the voltage supply line is below the gate threshold voltage.

6. The apparatus of claim 5, wherein the second circuit includes a second transistor configured and arranged to pass current between the second resistor and the ground circuit in response to a gate voltage provided by the bandgap reference voltage circuit, and the threshold voltage is a value defined by the sum of the bandgap reference voltage and respective threshold voltages of the first and second transistors.

7. The apparatus of claim 1, wherein the first and second circuits are configured and arranged to, in response to a voltage on the bandgap voltage supply line that is not higher than a bandgap reference voltage output level of the bandgap reference voltage circuit, pass a first amount of current received via the voltage supply line to the bandgap reference voltage circuit, a second smaller amount of the current received to ground via the second circuit, and a negligible amount of the current received to ground via the first circuit, the first amount being a majority of the current, and in response to a voltage on the bandgap voltage supply line that is higher than the bandgap reference voltage, pass the same first and second amounts of the current received via the voltage supply line respectively to the bandgap reference voltage circuit and to the second circuit, and pass all additional current to ground via the first circuit.

8. The apparatus of claim 1, further including at least one circuit coupled to receive the bandgap reference voltage output of the bandgap reference voltage circuit and configured and arranged to operate using the bandgap reference voltage output.

9. The apparatus of claim 1, wherein the capacitor is configured and arranged to mitigate coupling of transient voltages between the bandgap voltage supply line and the gate of the first transistor.

10. The apparatus of claim 1, further including an operational transconductance amplifier having a negative input coupled to the bandgap voltage supply line, a positive input coupled to the capacitor and an output connected to the gate.

11. An apparatus comprising:

a low voltage supply circuit configured and arranged to provide a low voltage output using an internal voltage line subject to voltage fluctuations;

a current limit circuit configured and arranged to couple the internal voltage line to a line voltage line and to limit current passed between the line voltage and the internal voltage line;

a startup circuit connected between the internal voltage line and a reference circuit, the startup circuit being configured and arranged to provide a startup voltage for the low voltage supply circuit; and a shunt circuit coupled between the internal voltage line and the reference circuit and responsive to a control signal from the startup circuit, the shunt circuit including a switch and a control circuit configured and arranged to control the switch to shunt current between the internal voltage line and the reference circuit and regulate voltage on the internal voltage line at an about constant level, wherein the control signal from the startup circuit is arranged to ensure that the shunt circuit does not drain current until the internal voltage is at a minimum voltage for operation of the low voltage supply circuit, and wherein the control circuit includes a resistor coupled between the internal voltage line and the switch, and a capacitor coupled between the switch and the reference circuit.

12. The apparatus of claim 11, wherein the control circuit is configured and arranged to respond to the control signal startup circuit and to provide an about constant voltage to the switch under different voltage levels on the internal voltage line, to control the switch in a closed position to shunt current between the internal voltage line and the reference circuit and regulate voltage on the internal voltage line at an about constant level.

13. The apparatus of claim 11, wherein the control circuit is coupled between the internal voltage line and the switch and is activated by the control signal from the startup circuit.

14. The apparatus of claim 11, wherein the a startup circuit is configured and arranged with a voltage drop that is about equal to a saturation voltage for saturating one or more transistors in a current path within the low voltage supply circuit between the internal voltage line and an output of the low voltage supply circuit.

15. The apparatus of claim 11, wherein the capacitor is configured and arranged to mitigate coupling of transient voltages between the internal voltage line and the switch, and wherein the control circuit is configured and arranged to respond to the control signal startup circuit and to provide an about constant voltage to the switch under different voltage levels on the internal voltage line, to control the switch in a closed position to shunt current between the internal voltage line and the reference circuit and regulate voltage on the internal voltage line at an about constant level and is activated by the control signal from the startup circuit.

a current limit circuit configured and arranged to couple the internal voltage line to a line voltage line and to limit current passed between the line voltage and the internal voltage line;

a startup circuit connected between the internal voltage line and a reference circuit, the startup circuit being configured and arranged to provide a startup voltage for the low voltage supply circuit; and a shunt circuit coupled between the internal voltage line and the reference circuit and responsive to a control signal from the startup circuit, the shunt circuit including a switch and a control circuit configured and arranged to control the switch to shunt current between the internal voltage line and the reference circuit and regulate voltage on the internal voltage line at an about constant level, wherein the control signal from the startup circuit is arranged to ensure that the shunt circuit does not drain current until the internal voltage is at a minimum voltage for operation of the low voltage supply circuit, and wherein the control circuit includes a resistor coupled between the internal voltage line and the switch, and a capacitor coupled between the switch and the reference circuit.

16. The apparatus of claim 11, wherein the startup circuit includes transistors and a p-n-p diode coupled in series between the internal voltage line reference circuit, and is coupled to mitigate current flow via the shunt circuit by influencing a voltage provided to the switch.

17. The apparatus of claim 11, wherein the startup circuit is configured and arranged to provide a startup voltage for the low voltage supply circuit by mitigating current flow via the shunt circuit in response at voltage levels on the internal voltage line below a minimum voltage at which the low voltage supply circuit operates to provide a low voltage output.

18. An apparatus comprising:

a low voltage supply circuit configured and arranged to provide a low voltage output using an internal voltage line subject to voltage fluctuations;

a current limit circuit configured and arranged to couple the internal voltage line to a line voltage line and to limit current passed between the line voltage and the internal voltage line;

a startup circuit connected between the internal voltage line and a reference circuit, the startup circuit being configured and arranged to provide a startup voltage for the low voltage supply circuit; and a shunt circuit coupled between the internal voltage line and the reference circuit and responsive to a control signal from the startup circuit, the shunt circuit including a switch and a control circuit configured and arranged to control the switch to shunt current between the internal voltage line and the reference circuit and regulate voltage on the internal voltage line at an about constant level, wherein the control signal from the startup circuit is arranged to ensure that the shunt circuit does not drain current until the internal voltage is at a minimum voltage for operation of the low voltage supply circuit, and wherein the control circuit includes a resistor coupled to the internal voltage line, a capacitor coupled between the resistor and the reference circuit, and an operational transconductance amplifier having a negative input coupled to the internal voltage line, a positive input coupled to the capacitor and an output connected to the switch and configured and arranged to switch the switch between conductance states.

19. An apparatus comprising:

a first transistor having a source, drain and gate;

a ground circuit connected to the drain of the first transistor;

a first resistor connected between a line voltage supply line and both an internal voltage rail and the source of the first transistor;

a capacitor connected between the drain and gate of the first transistor and configured and arranged to maintain a voltage level at the gate of the first transistor at an about constant value in response to a voltage on the internal voltage rail of at least the constant value, the first transistor being configured and arranged to drain current between the voltage line and the ground circuit in response to an increase in voltage of the internal voltage rail above the constant value;

a second resistor connected between the first resistor and the gate of the first transistor;

a bandgap reference voltage circuit connected to the internal voltage rail and configured and arranged to provide a bandgap reference voltage output using voltage supplied via the internal voltage rail and regulated via the first transistor;

a second transistor connected between the gate of the first transistor and the ground circuit, the second transistor having a gate coupled to receive the output of the bandgap reference voltage circuit; and a diode connected to the ground circuit and a third transistor connected between the diode and the second transistor, the diode and second and third transistors being configured and arranged to mitigate current flow via the first transistor in response to a voltage level on the internal voltage rail being below the level of the bandgap reference voltage.

* * * * *